US007581977B1

(12) United States Patent
Wu

(10) Patent No.: US 7,581,977 B1
(45) Date of Patent: Sep. 1, 2009

(54) SAFETY SOCKET

(75) Inventor: Jui-Hsiung Wu, Taipei (TW)

(73) Assignee: Well Shin Technology Co., Ltd., Taipei (TW)

( * ) Notice: Subject to any disclaimer, the term of this patent is extended or adjusted under 35 U.S.C. 154(b) by 0 days.

(21) Appl. No.: 12/327,147

(22) Filed: Dec. 3, 2008

(51) Int. Cl.
*H01R 13/625* (2006.01)
*H01R 4/50* (2006.01)

(52) U.S. Cl. ..... 439/346; 439/106; 439/140

(58) Field of Classification Search ..... 439/346, 439/147, 263, 270, 102, 106, 268, 348, 145, 439/911, 139, 140, 345
See application file for complete search history.

(56) References Cited

U.S. PATENT DOCUMENTS 4,932,886 A * 6/1990 Glaser ..... 439/137
7,083,458 B1 * 8/2006 Chang ..... 439/346

* cited by examiner

*Primary Examiner*—Hae Moon Hyeon
(74) *Attorney, Agent, or Firm*—WPAT, P.C.; Anthony King

(57) ABSTRACT

A safety socket adapted for connecting with a terminal of a plug includes a socket housing with at least one electrode mounted thereon, a socket cover engaged with the socket housing, and a fixing case mounted in the socket housing. The socket cover has a plurality of insertion holes for allowing the terminals to pass therethrough. The fixing case includes an insulating housing and an electrode component. The electrode component has a pivotal portion pivoted on the insulating housing, a contacting portion and a pressing portion respectively extended from two opposite ends of the pivotal portion. The contacting portion is underlain the electrode with a small gap. The pressing portion is located under the corresponding insertion hole for being pressed downwardly by the inserted terminal to make the contacting portion be uplifted to electrically connect with the electrode.

9 Claims, 6 Drawing Sheets

SAFETY SOCKET

BACKGROUND OF THE INVENTION

1. Field of the Invention

This present invention relates to a socket, and more specifically to a safety socket capable of preventing electric shock.

2. The Related Art

Electronic products have developed rapidly over the past few decades. With more sockets utilized than before, the safety structure is apparently important for the socket. Generally, an insertion hole of the socket has an electrode made by copper sheet for electrically connecting with a plug. Such socket can be electrically connected with the plug even if a terminal of the plug is not fully inserted into the insertion hole of the socket. As a result, it is easy to cause accidents, for example, electric shock happens when a user contacts the terminal during insertion or extraction of the plug unintentionally. So there is a need to design a socket which is able to prevent electric shock.

SUMMARY OF THE INVENTION

An object of the invention is to provide a safety socket capable of preventing electric shock efficiently and being operated conveniently. The safety socket adapted for connecting with a terminal of a plug includes a socket housing with at least one electrode mounted thereon, a socket cover engaged with the socket housing, and a fixing case mounted in the socket housing. The socket cover has a plurality of insertion holes for allowing the terminals to pass therethrough. The fixing case includes an insulating housing and an electrode component. The electrode component has a pivotal portion pivoted on the insulating housing, a contacting portion and a pressing portion respectively extended from two opposite ends of the pivotal portion. The contacting portion is underlain the electrode with a small gap. The pressing portion is located under the corresponding insertion hole for being pressed downwardly by the inserted terminal to make the contacting portion be uplifted to electrically connect with the electrode.

As described above, the pressing portion is pressed downwardly by the terminal so that the contacting portion is uplifted to connect with the electrode electrically. Namely, the safety socket can be connected with the plug electrically only if the terminal is fully inserted into the safety socket so as to make the contacting portion be uplifted. Thus the terminal is not electrified before pressing the pressing portion, which effectively prevents the electric shock during the insertion or extraction of the plug. Furthermore, because this safety socket dose not require accessorial elements or other operations to achieve such function, the safety socket is more convenient for a user to operate.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE EMBODIMENT

Figure 1:
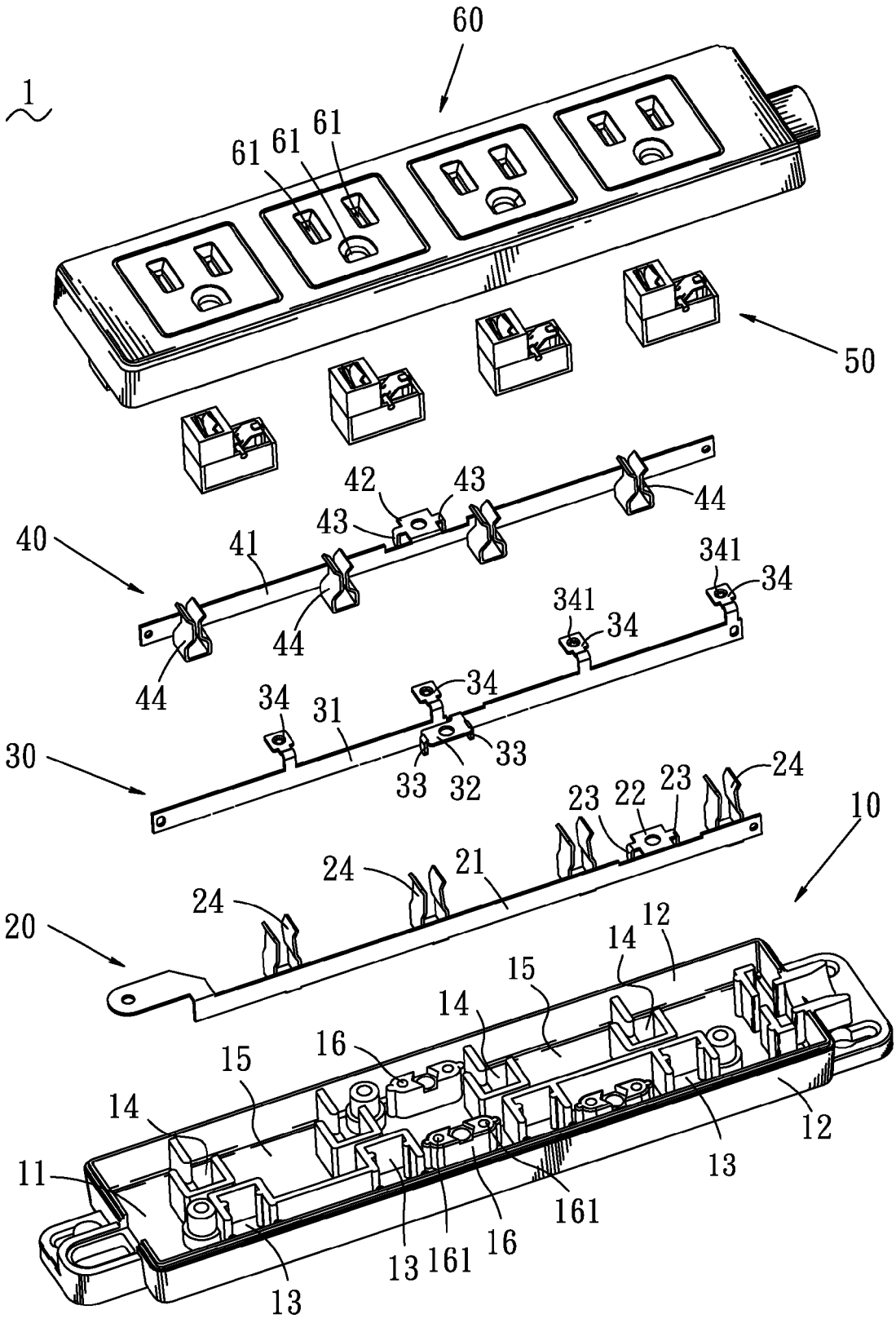
FIG. 1 is an exploded, perspective view of a safety socket of an embodiment in accordance with the present invention.

Referring to FIG. 1, an embodiment of a safety socket 1 according to the present invention is shown. The safety socket 1 includes a socket housing 10, a first connection element 20, a second connection element 30, a third connection element 40, a plurality of fixing cases 50 and a socket cover 60 engaged with the socket housing 10.

The socket housing 10 has a basic plate 11 and a sidewall 12 enclosing the basic plate 11 to form a receiving chamber. A plurality of first, second and third receiving portions 13, 14, 15 are formed in the receiving chamber. The first receiving portions 13 are arranged at intervals in a first row and respectively define an opening facing a front of the socket housing 10. The second receiving portions 14 are arranged at intervals in a second row spaced from the first row with a narrow gap and respectively define an opening facing a rear of the socket housing 10. The third receiving portions 15 are formed at intervals in the second row. Each of the third receiving portions 15 is adjacent to the corresponding second receiving portion 14 and has a receiving space bigger than that of the second receiving portion 14. The basic plate 11 further has a plurality of holding portions 16 for fixing the first connection element 20, the second connection element 30 and the third connection element 40, respectively. Each of the holding portions 16 has two holding holes 161 arranged abreast on a top thereof.

The first connection element 20 mounted in the first row has a first conductive portion 21. The first conductive portion 21 is an elongated plate shape. A portion of a top edge of the first conductive portion 21 extends substantially perpendicular to the first conductive portion 21 to form a first fixing portion 22 for covering the top of the corresponding holding portion 16. Middles of two sides of the first fixing portion 22 are bent downwardly to form buckling portions 23. The buckling portion 23 is inserted into the corresponding holding hole 161 for fixing the first connection element 20 to the socket housing 10. A bottom edge of the first conductive portion 21 has portions extending upwards to form a plurality of first electrodes 24. The first electrode 24 is U-shaped and received in the corresponding first receiving portion 13 of the first row.

The second connection element 30 mounted in the socket housing 10 has a second conductive portion 31 of elongated plate shape. A top edge of the second conductive portion 31 extends substantially perpendicular to the first conductive portion 31 to form a second fixing portion 32 corresponding to the holding portion 16. Middles of two sides of the second fixing portion 32 are bent downwardly to form buckling portions 33 inserted into the corresponding holding holes 161. The top edge of the second conductive portion 31 further has portions extending substantially perpendicular to the second conductive portion 31 to form a plurality of second electrodes 34 corresponding to the third receiving portions 15. The second electrode 34 is rectangular and has a mating hole 341 at a center thereof.

The third connection element 40 is mounted in the second row of the socket housing 10. The construction of the third connection element 40 is somewhat analogous to that of the first connection element 20. The difference between the first connection element 20 and the third connection element 40 is that the position of a third fixing portion 42 and third electrodes 44 of the third connection element 40 is arranged corresponding to the corresponding holding portion 16 and the second receiving portions 14 for securing the third connection element 40 to the socket housing 10 and placing the third electrodes 44 in the corresponding second receiving portions 14. In addition, in this embodiment, the third electrodes 44 are smaller than the first electrodes 24.

Figure 2:
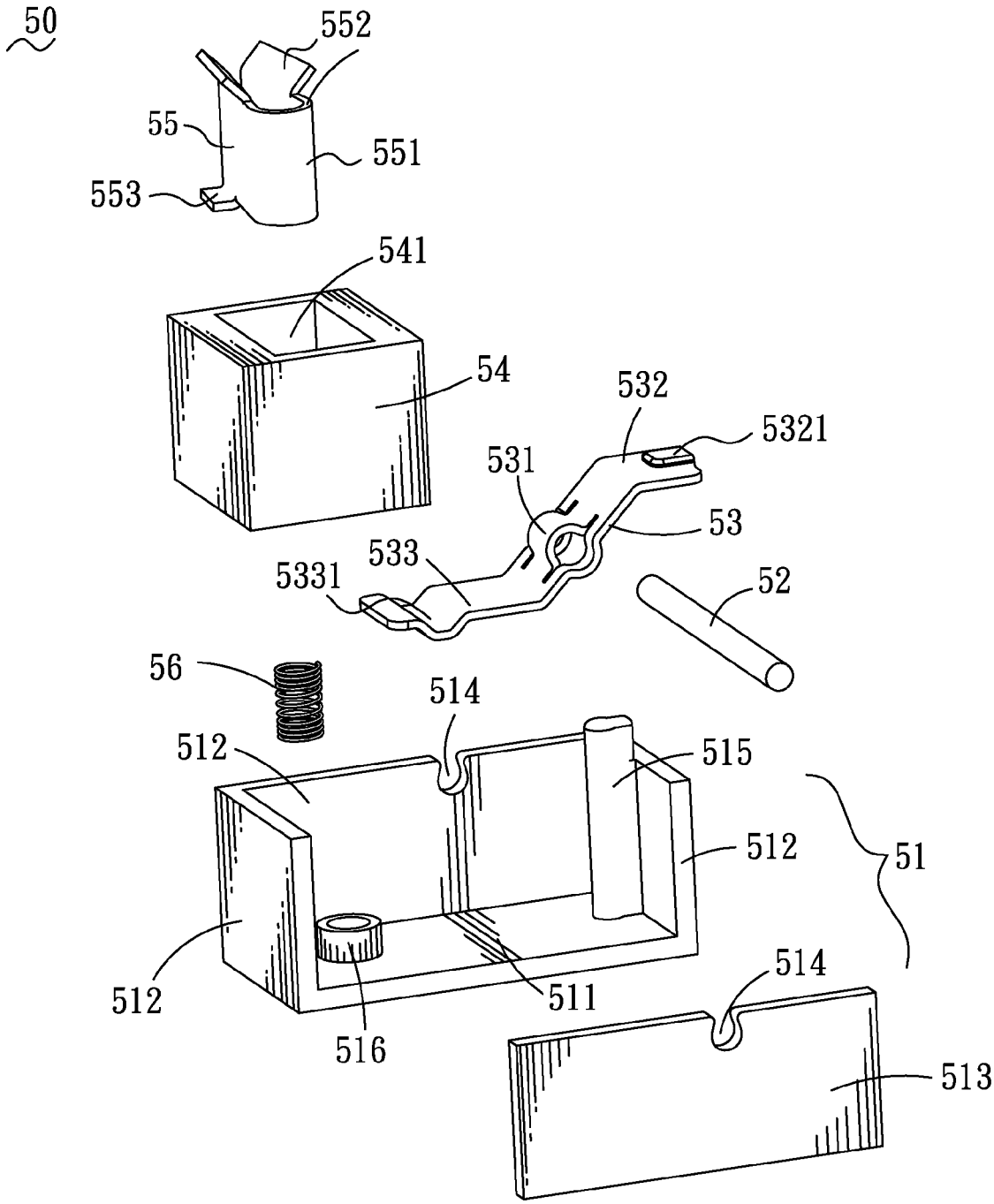
FIG. 2 is an exploded, perspective view of a fixing case of the safety socket shown in FIG. 1.

Please refer to FIG. 1 and FIG. 2, the fixing case 50 includes an insulating housing 51, an electrode component 53, an accommodating frame 54 and an elastic component 55 mounted in the accommodating frame 54. The insulating housing 51 has a rectangular bottom plate 511, a first lateral plate 512 bending upwards from three edges of the bottom plate 511 and a second lateral plate 513 removably mounted at the bottom plate 511 to form a closed frame. In this embodiment, the closed frame also can be formed by the first lateral plate 512 enclosing the bottom plate 511. The first lateral plate 512 and the second lateral plate 513 respectively have a pivotal recess 514 at a middle of a top thereof. The two pivotal recesses 514 facing each other are adapted for holding a pivotal shaft 52 thereon. The insulating housing 51 further has a supporting portion 515 and an accommodating portion 516 which are all located in the closed frame. The supporting portion 515 of substantial pillar-shape is located at one end of the bottom plate 511 and higher than the first lateral plate 512. The accommodating portion 516 of cylindraceous shape is located at the other end of the bottom plate 511 and lower than the supporting portion 515, receiving an elastic element 56 therein, such as a spring. Furthermore, the accommodating portion 516 and the supporting portion 515 are substantially aligned with each other.

The electrode component 53 defines a pivotal portion 531 pivoted on the pivotal shaft 52. In this embodiment, the pivotal portion 531 may be manufactured by punching technology. One end of the pivotal portion 531 extends outwards to form a contacting portion 532. The contacting portion 532 is disposed on the supporting portion 515 and has a portion protruding upwards to form a protrusion 5321 corresponding to the mating hole 341 for steady connection. The other end of the pivotal portion 531 extends parallel to the contacting portion 532 to form a pressing portion 533. The pressing portion 533 is disposed lower than the contacting portion 532 and supported by the elastic element 56. A free end of the pressing portion 533 has a portion curved to form a positioning portion 5331 of downward concave shape for preventing a terminal of a plug (not shown) from sliding thereon.

Figure 5:
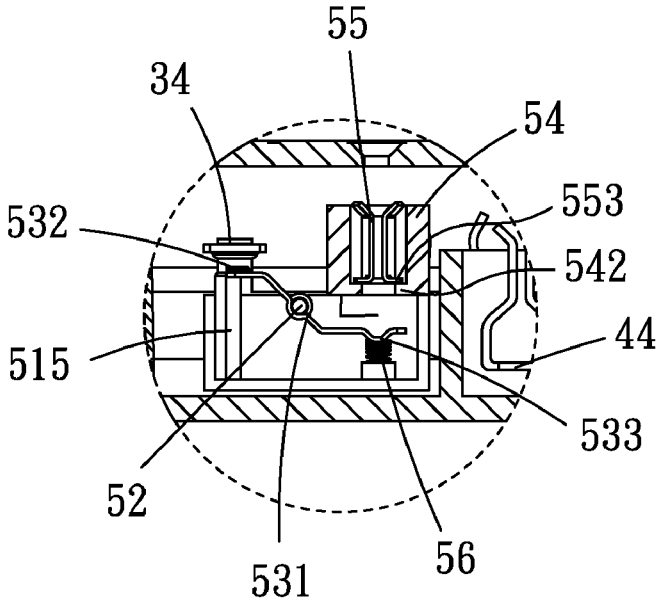
FIG. 5 is a partly enlarged view showing an enlarged V portion of FIG. 4.

Please refer to FIG. 2 and FIG. 5, the accommodating frame 54 placed above the insulating housing 51 is rectangular and has a through hole 541 for receiving the elastic component 55. Two bottom sides of the through hole 541 extend inwards a predetermined distance to form a protruding portion 542, respectively. The elastic component 55 may be made of insulating material or metal material, and has a bending portion 551. The bending portion 551 of substantially U-shape, with an opening thereof narrowed, is placed in the through hole 541 for elastically clamping the inserted terminal. Two facing portions of a top side of the bending portion 551 are curved outwards to form a leading portion 552, respectively, for conveniently inserting the terminal into the bending portion 551. A bottom side of the bending portion 551 has two portions perpendicularly extending outwards to form a resistive portion 553 respectively. The resistive portion 553 is placed on the protruding portion 542 for carrying the elastic component 55.

Figure 3:
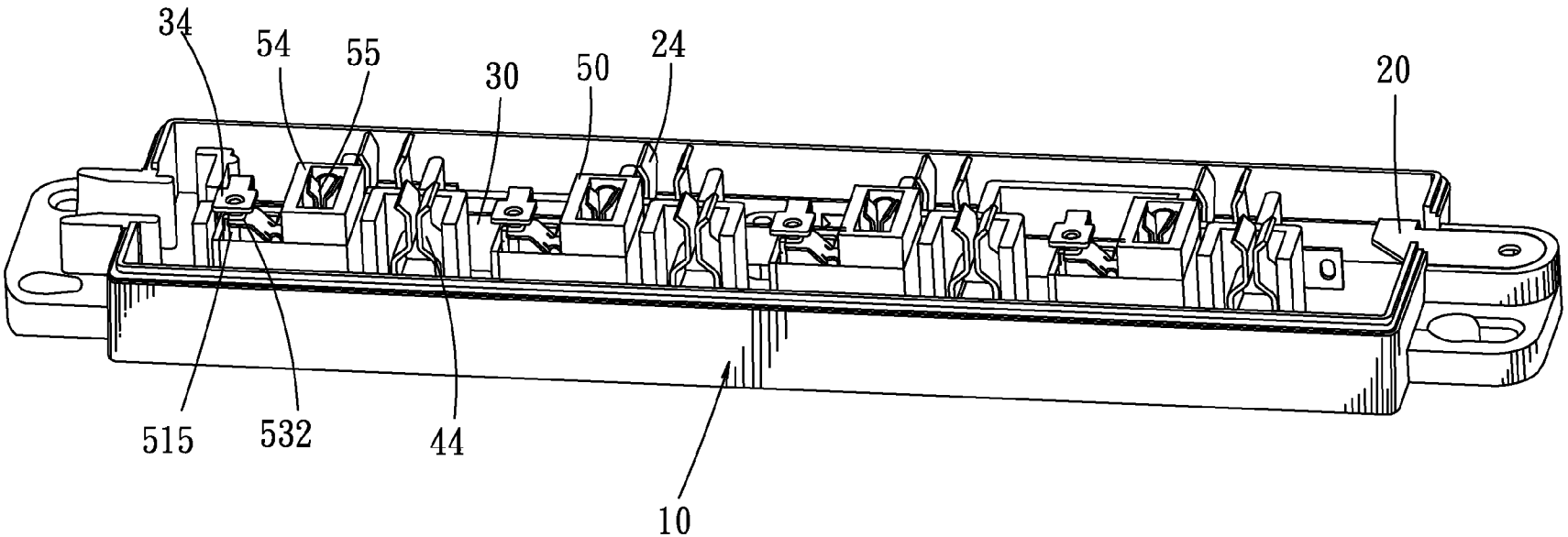
FIG. 3 is an assembled, perspective view of the safety socket shown in FIG. 1, wherein a socket cover is removed.

With reference to FIG. 1, FIG. 3 and FIG. 5, the first connection element 20, the second connection element 30 and the third connection element 40 are received in the socket housing 10 in turn. The buckling portions 23, 33 and 43 are inserted into the holding holes 161, respectively, for fixing the first connection element 20, the second connection element 30 and the third connection element 40 into the socket housing 10. The first and third electrodes 24 and 44 are respectively accommodated in the corresponding first receiving portions 13 and second receiving portions 14. The second electrode 34 is suspended above the contacting portion 532 of the fixing case 50 received in the third receiving portion 15 with a small gap. The socket cover 60 with a plurality of insertion holes 61 for allowing the terminal to pass therethrough is engaged with the socket housing 10.

Figure 4:
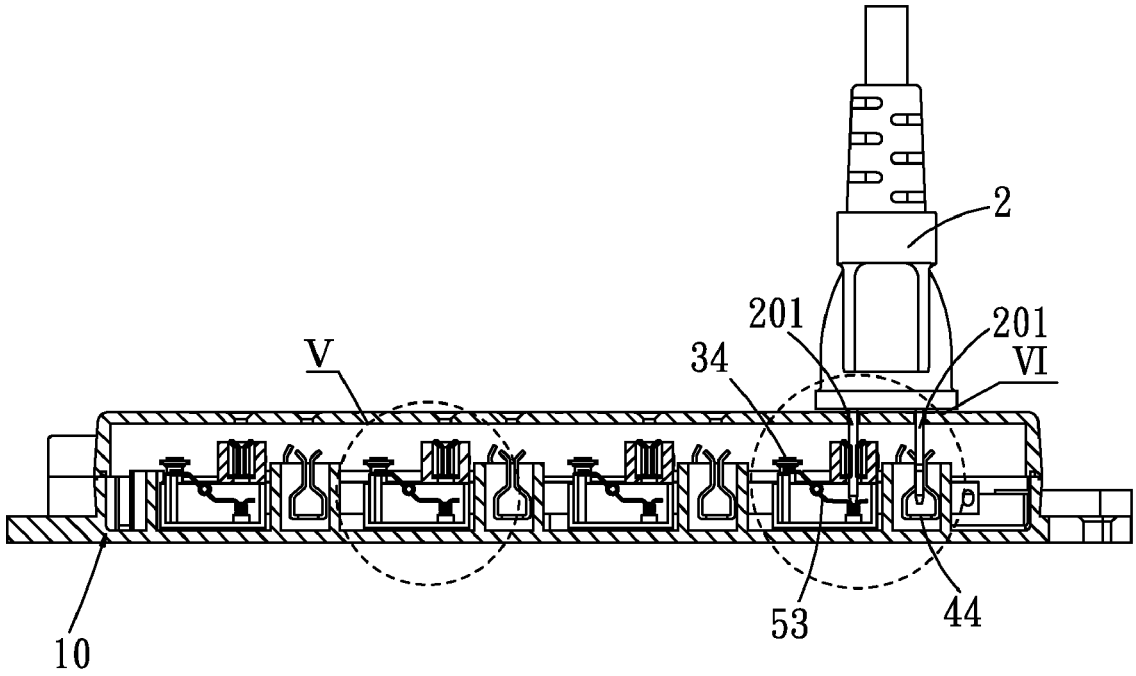
FIG. 4 is a cross-sectional view illustrating a state of a plug incompletely inserted into the safety socket of FIG. 1.
Figure 6:
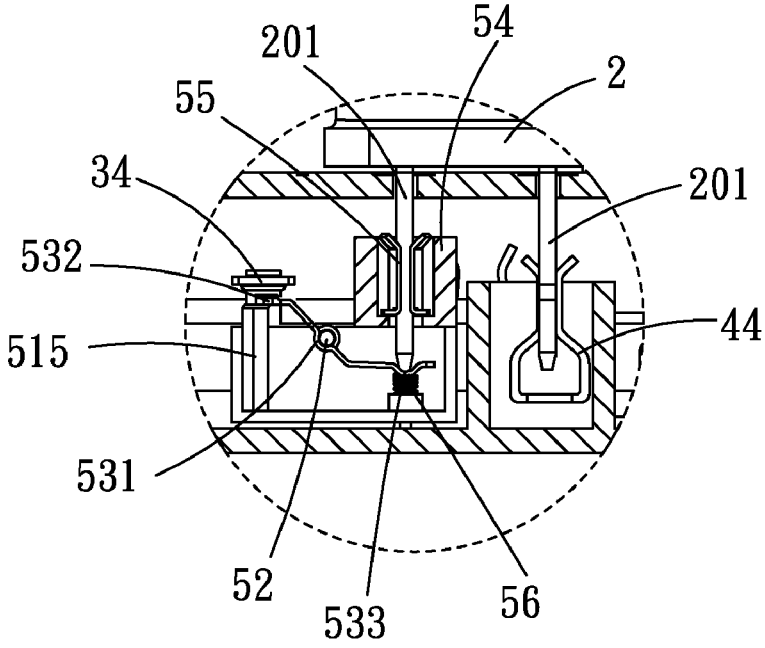
FIG. 6 is a partly enlarged view showing an enlarged VI portion of FIG. 4.
Figure 7:
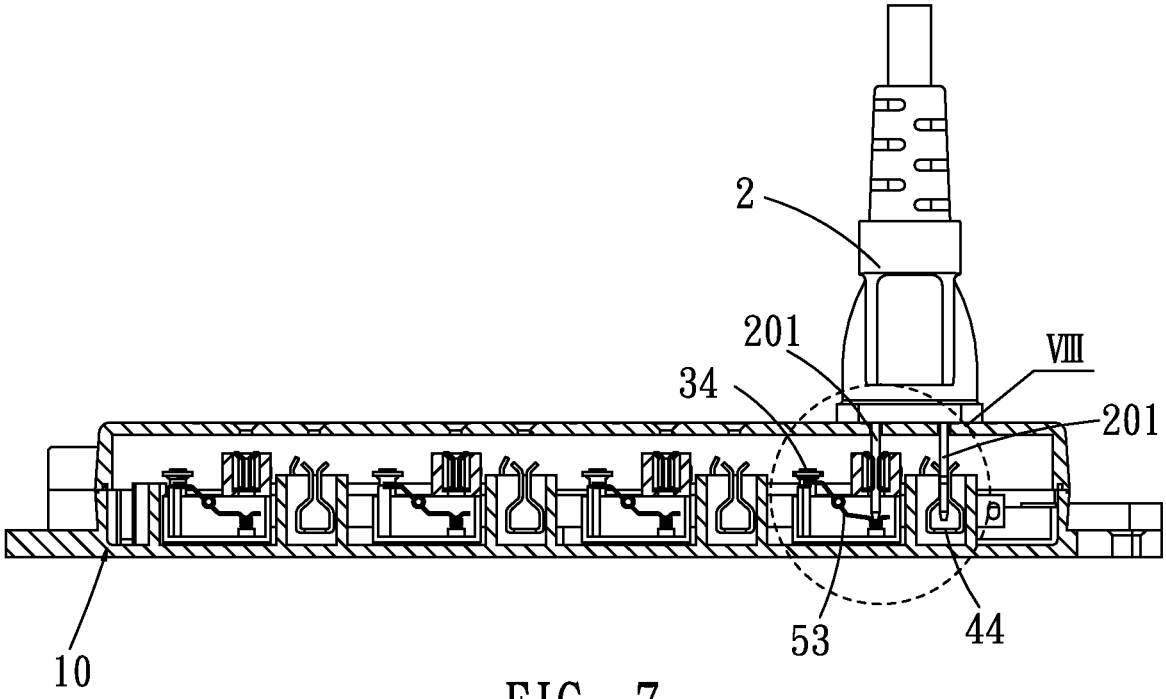
FIG. 7 is a cross-sectional view illustrating a state of the plug fully inserted into the safety socket of FIG. 1.
Figure 8:
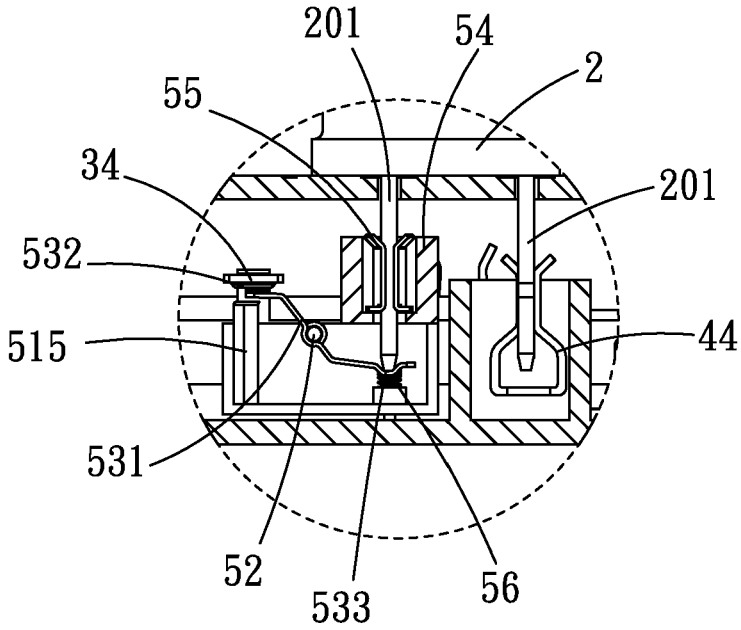
FIG. 8 is a partly enlarged view showing an enlarged VIII portion of FIG. 7.

Please refer to FIG. 2, FIG. 4 and FIG. 6, when a plug 2 is inserted into the safety socket 1, a terminal 201 of the plug 2 is firstly pushed to pass through the bending portion 551 under the guidance of the leading portion 552 until the terminal 201 contacts the pressing portion 533. In this process, because the contacting portion 532 is not connected with the second electrode 34, the terminal 201 is not electrified and accordingly, it is safe for a user to operate. Please refer to FIG. 7 and FIG. 8, the plug 2 is needed to be continually pressed inwards, the terminal 201 is pushed to press the pressing portion 533 downwards such that the contacting portion 532 is uplifted to be electrically connected with the second electrode 34. At this time, the terminal 201 is electrically connected with the safety socket 1. Because the terminal 201 of the plug 2 exposed outside is so short that it is not easy to happen accidents. Therefore the safety socket 1 is capable of preventing from electric shock effectively.

As described above, the pressing portion 533 is pressed downwardly by the terminal 201 so that the contacting portion 532 is uplifted to connect with the second electrode 34 electrically. Namely, the safety socket 1 can be connected with the plug 2 electrically only if the terminal 201 is fully inserted into the safety socket 1. Thus the terminal 201 is not electrified before pressing the pressing portion 533, which effectively prevents electric shock during the insertion or extraction of the plug 2 and has better performance of safety. Furthermore, because this safety socket 1 dose not require accessorial elements or other operations to achieve such function, the safety socket 1 is more convenient for the user to operate.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A safety socket adapted for connecting with a terminal of a plug, comprising:

a socket housing with at least one electrode mounted thereon;

a socket cover engaged with the socket housing, the socket cover having a plurality of insertion holes for allowing the terminals to pass therethrough; and a fixing case mounted in the socket housing including an insulating housing and an electrode component, the electrode component having a pivotal portion pivoted on the insulating housing, a contacting portion and a pressing portion respectively extended from two opposite ends of the pivotal portion, the contacting portion underlain the electrode with a small gap, the pressing portion located under the corresponding insertion hole for being pressed downwardly by the inserted terminal to make the contacting portion be uplifted to electrically connect with the electrode.

2. The safety socket as claimed in claim 1, wherein the insulating housing has an accommodating portion and a supporting portion substantially aligned with the accommodating portion, the contacting portion is laid on the supporting portion, the pressing portion is elastically supported by an elastic element disposed at the accommodating portion.

3. The safety socket as claimed in claim 2, wherein the supporting portion is higher than the accommodating portion.

4. The safety socket as claimed in claim 2, wherein the accommodating portion is cylindraceous for steadily holding the elastic element therein.

5. The safety socket as claimed in claim 1, wherein the insulating housing includes a rectangular bottom plate, a first lateral plate bending perpendicularly from three edges of the bottom plate and a second lateral plate removably mounted at the bottom plate for forming a closed frame, the accommodating portion and the supporting portion are located in the closed frame.

6. The safety socket as claimed in claim 5, wherein the first lateral plate and the second lateral plate respectively have a pivotal recess, the pivotal recesses facing each other are adapted for supporting a pivotal shaft, the pivotal portion of the electrode component is pivotally mounted on the pivotal shaft.

7. The safety socket as claimed in claim 1, wherein the fixing case further comprises an accommodating frame disposed above the insulating housing and an elastic component received in the accommodating frame, the elastic component defining a U-shaped bending portion disposed in the accommodating frame for elastically clamping the inserted terminal.

8. The safety socket as claimed in claim 1, wherein the pressing portion has a positioning portion of downward concave shape for preventing the terminal from sliding thereon.

9. The safety socket as claimed in claim 1, wherein the contacting portion has a portion protruding upwards to form a protrusion, the electrode has a mating hole corresponding to the protrusion for making the contacting portion connect with the electrode steadily.

* * * * *